United States Patent [19]

Bergman et al.

[11] Patent Number: 4,598,573

[45] Date of Patent: Jul. 8, 1986

[54] METHOD OF FORMING AN OBJECT BY PRESSING A BLANK IN A PRESS

[75] Inventors: Carl Bergman; Göran Holmström; Arne Nygård, all of Västerås, Sweden

[73] Assignee: ASEA Aktiebolag, Västerås, Sweden

[21] Appl. No.: 737,475

[22] Filed: May 24, 1985

[30] Foreign Application Priority Data

May 28, 1984 [SE] Sweden ..... 8402876

[51] Int. Cl.[4] ..... B21D 37/12

[52] U.S. Cl. ..... 72/455; 72/465

[58] Field of Search ..... 72/455, 462, 465

[56] References Cited

FOREIGN PATENT DOCUMENTS 1316191 5/1973 United Kingdom ..... 72/465

*Primary Examiner*—W. D. Bray

*Attorney, Agent, or Firm*—Watson, Cole, Grindle & Watson

[57] ABSTRACT

A press is adapted for the press tool it is to operate, by means of at least one pad of force-transmitting material formed in situ on a surface adapted to transmit the forming force to the press tool. The pad is formed by locating a tool substitute in the space intended for the tool, defining at least one volume between the tool substitute and the said surface adapted to transmit the forming force with a sealing means and injecting the pad forming material in liquid state into the said volume to allow the same to harden there preferably under a force equivalent to that which will be used in forming a blank when the substitute tool is replaced by the press tool.

9 Claims, 4 Drawing Figures

METHOD OF FORMING AN OBJECT BY PRESSING A BLANK IN A PRESS

TECHNICAL FIELD

This invention relates to object-forming presses and in particular relates to a method of adapting a press to the press tool it is to be used with.

In the manufacture of, for example, a plate heat exchanger of embossed sheet metal, it is of the utmost importance that the embossing of the sheet metal blank is effected with great precision so that no leakage occurs between the embossed sheets when they are located adjacent each other, in the stack of sheets with intermediate seals from which the plate heat exchanger is built up. The embossing of the blanks is normally carried out in a high pressure press. It is then a condition for the required precision during the embossing that the male and female parts of the press tool are parallel during the pressing operation. For this purpose the presses are constructed with press tables which are as rigid as possible, so that any deflection thereof and any consequent bending of the tool caused thereby will be as small as possible.

DISCUSSION OF PRIOR ART

The normally used method of counteracting for deflection in the press tables, is to make the presses very large with thick press tables. Another prior art method is to compensate for the deflection of the press tables by inserting thin, so-called shim plates, between the press table and the tool. For the same press the deviation in parallelism of the formed tool parts is, of course, dependent on the magnitude of the pressing force employed.

The present invention makes it possible to eliminate adverse effects caused by the deflection of a press table, so that pressed parts can be formed with excellent precision. Using the method of the invention, these favourable results can be achieved without difficulty in relatively light presses, such as presses built up from two yokes, intermediate spacers and a wire-wound mantle wound around the yokes and the spacers. The method according to the invention is well suited to the manufacture of embossed sheets for plate heat exchangers and other parts where high demands are placed on a thin and even thickness of the part, such as plastic hoods for automobiles.

SUMMARY OF THE INVENTION

The present invention relates to a method of forming an object by pressing of, for example, a sheet metal blank in a tool arranged between two pressure-transmitting parts in a press, which parts are movable relatively to each other, said tool comprising two consecutively arranged parts positioned in the direction of movement of the pressure-transmitting parts. The invention is characterized in that a tool-substitute plate, which is resistant to deformation, is placed in the position of the tool in the press, said plate having one side facing each one of the pressure-transmitting parts and having at least one side arranged at a distance from the adjacent pressure-transmitting part so that a gap or space is created between this side of the plate and the adjacent pressure-transmitting part, which space in the lateral direction is limited by a sealing strip which surrounds the gap and which can at least be partially pressed into the tool-substitute plate, whereafter a formable material is placed in the gap and the formable material is converted into a solid force-transmitting body or pad having the same shape as the gap while the pressure-transmitting parts are being pressed against each other, the tool-substitute plate with the sealing strip thereafter being removed from the press and replaced by the tool, whereupon the sheet metal blank to be pressed is formed in the tool with the solid forming body or pad located between a tool part and the adjacently located pressure-transmitting part.

To counter bending of the tool to the maximum possible extent, gaps for the formable material are preferably arranged on both sides of the deformation-resistant tool-substitute plate.

For optimum utilization of the present invention the pressure-transmitting parts are pressed against each other while the formable material is converted to a solid pad or pads with a pressing force which is at least substantially as great as the pressing force by which the pressure-transmitting parts are expected to be pressed against each other when forming the sheet metal blank. This ensures that the tool is influenced by the press under the same conditions as the tool-substitute was when the pad/pads is/are formed in situ.

The formable material, for the pad or pads should have the ability to spread in the gap provided and to have the same hydrostatic pressure in all parts of the gap. The surface pressure is then equally great against all parts of the press which are in contact with the formable material when it is converted into a pad. The formable material preferably consists of a thermosetting resin, especially a solvent-free thermosetting resin such as an unsaturated polyester resin, an epoxy resin or a polyurethane resin. The thermosetting resin is suitably supplied with a filler in powdered state, such as e.g. chalk, talcum, mica powder or cellulose powder and with a fibrous reinforcing material such as fibers of e.g. glass, cotton or polyamide. The thermosetting resin is liquid or plastically formable and preferably curable at room temperature or at a somewhat elevated temperature, so that the tool-substitute plate or other parts making contact with the plastics material in the press do not have to be heated up. The formable material may, in principle, also consist of a thermoplastic resin, for example polypropylene, of a metallic material, for example lead, or of a ceramic material, the material then being of such a kind that it can be applied in liquid or formable state and be converted into the pads by allowing the material to solidify while the pressure-transmitting parts of the press are pressed against each other. The pads formed should have sufficient resistance to deformation to withstand yielding of material therein perpendicular to the direction of movement of the pressure-transmitting parts of the press when these parts are pressed against each other when the real tool is in place and in use.

The tool-substitute plate, which may advantageously be of steel, is in normal applications plane-parallel, since the tool is externally normally plane-parallel. The same demands for precision are placed on the tool-substitute as on the real tool.

The sealing strip preferably consists of a material having a different hardness than the material of the tool-substitute plate such that the friction between the plate and the sealing strip is small, but the sealing strip may also be of the same material. A lubricant may be used between sliding surfaces on the sealing strip and the pressure-resistant plate. The material shall have good dimensional stability at the pressure use. Metallic materials, such as certain copper alloys, for example an alloy consisting of 82% Cu, 4% Ni, 10% Al and 4% Fe or an alloy of 88% Cu and 12% Sn (all percentage figures given in the application refer to percentage by weight), as well as different types of brass, are well suited for the sealing strip. Also steel, preferably of a hardness different from the steel in the tool-substitute plate, can be used.

BRIEF DESCRIPTION OF DRAWINGS

The invention will now be exlained in greater detail, by way of example, with reference to the accompanying drawing, wherein.

DESCRIPTION OF PREFERRED EMBODIMENT

Figure 1:
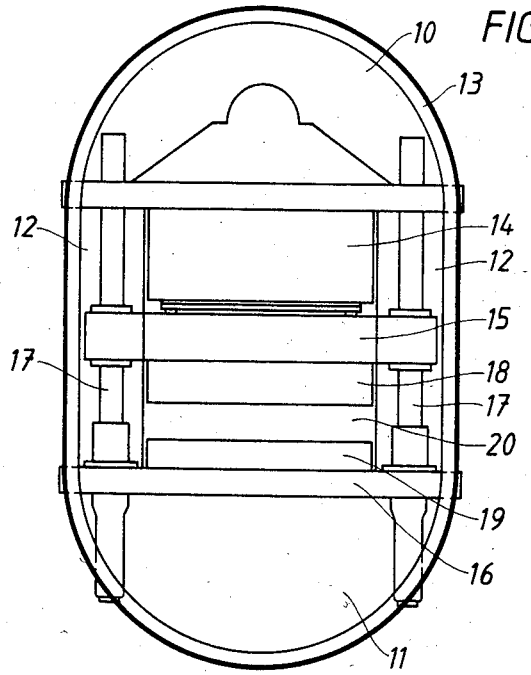
FIG. 1 illustrates a press to which the method of the invention can be applied.

FIG. 1 schematically illustrates a hydraulic press of a type which is built up of an upper yoke 10, a lower yoke 11, two spacers 12 and an encircling mantle 13 wound from pre-tensioned turns of thin metal strips. The press includes a hydraulic operating cylinder 14 which is connected to an upper press table 15 as well as to a fixed lower press table 16. The movement of the upper press table is controlled by four auxiliary cylinders 17, of which only two are visible in FIG. 1. In the illustrated case, two press plates 18 and 19 are located between the press tables 15, 16 and these press plates may constitute separate parts or be formed integrally with the respective press table. Between the plates 18 and 19 a space 20 is provided in which the press tools are arranged. The press tools confront the part which is to be pressed to form the desired object, for example an embossed plate for a plate heat exchanger.

Figure 2:
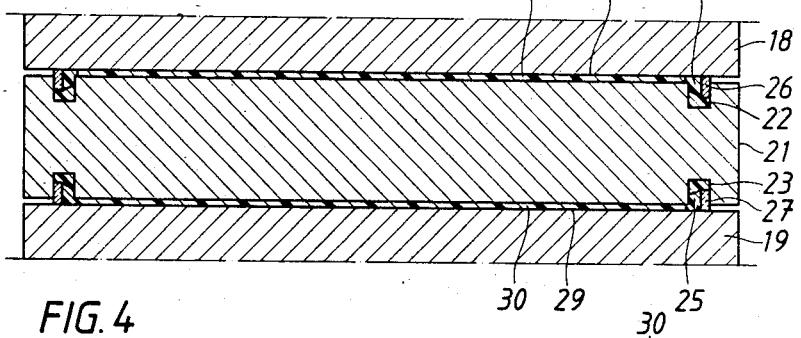
FIG. 2 illustrates the force-resistant plate or tool-substitute used in the method of the invention with material destined to form force-transmitting pads located on both sides thereof.

When putting the present invention into practice, a plate 21, which has a very high resistance to deformation is located in the space 20 and is faced on its upper and lower surfaces with layers of a formable material as shown in FIG. 2. The plate 21 acts as a substitute tool for the purpose now to be explained.

FIG. 2 has been drawn on a larger scale than used for the press in FIG. 1. The plate 21 is manufactured with great precision from tool steel to have two opposite plane parallel surfaces. The plate 21 is shaped to leave a recess 22 and 23, respectively, extending around the entire plate. Rubber gaskets 24 and 25, respectively, are arranged in these recesses, and sealing strips 26 and 27, respectively, make contact with and are insertable into these gaskets. The sealing strips 26, 27, conveniently consist of a copper alloy (e.g. consisting of 82% Cu, 4% Ni, 10% Al and 4% Fe). The sealing strips 26, 27, together with the outer faces of the plate 21 and the confronting faces of the plates 18 and 19 define respective spaces or gaps 28 and 29, respectively, on either side of the plate 21. A plastic material 30 is filled into these gaps, and this material can consist of an unsaturated polyester resin produced in a conventional manner from maleic acid, isophthalic acid and ethylene glycol, 1.5 mole of isophthalic acid and 2.7 mole of propylene glycol being used per mole of maleic acid, with additives. 30 parts by weight styrene, 1 part by weight methyl ethyl ketone peroxide and 0.1 part by weight accelerator in the form of cobalt octoate are added to 70 parts by weight of the polyester, and the product thus obtained is mixed with 67 parts by weight glass fiber and 167 parts by weight chalk. The plastic material is very flowable when first mixed and is easily distributed throughout the gaps 28 and 29, respectively.

Figure 3:
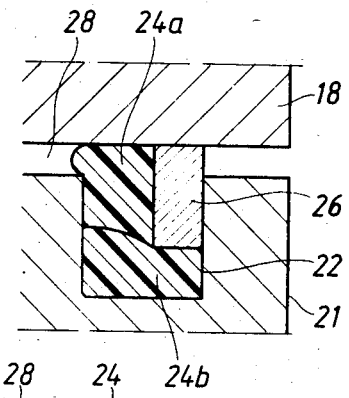
FIG. 3 is a part of FIG. 2, shown on an enlarged scale.

The plate 21 with the layers of formable plastic material in the gaps 28, 19 is then pressed between the parts 15, 18 and 16, 19 with a pressing force of P for approximately one hour, causing each sealing strip 26 and 27 to be pressed somewhat into the recesses 22 and 23 as illustrated in FIG. 3.

FIG. 3 shows the recess 22 with the rubber gasket 24 and the sealing strip 26 on a further enlarged scale. The rubber gasket, as shown, consists of two parts **24*a* and 24*b* which, before being deformed by the strip 26, have parallelepipedic cross-sections with the part 24*b* making contact via its long side with the bottom of the recess 22 and the part 24*a* making contact via its long side with one edge side of the recess 22. The strip 26 is pressed for the major part of its length into the recess, the gasket part 24*a* then being partially extruded out of the recess 22 to seal against the plate 18, thus contributing to a filling of the gap 28. During the curing of the layers of plastics material 30 at room temperature, the pressing force is kept constant at the value P (typically for about one hour) causing the plastics material to harden into a deformation-resistant disc which exactly fills each gap. The pressing force is then released, whereupon the plate 21 and the sealing strips 26 and 27 are removed from the press. The pre-shaped discs of cured material 30 are either left or, if they are removed, are carefully kept for accurate reinsertion in the same positions on the confronting faces of the press plates 18, 19** they occupied during their formation.

Figure 4:
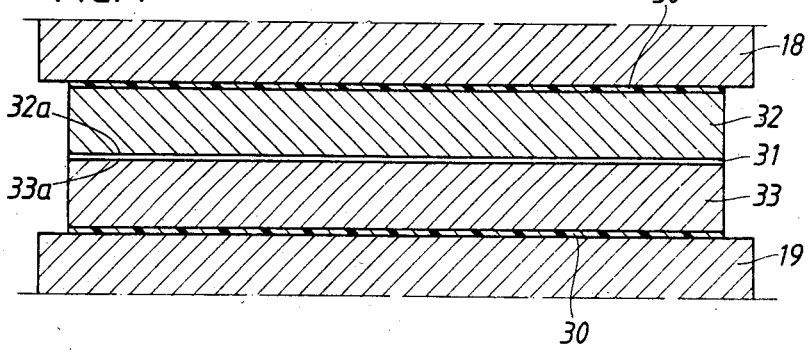
FIG. 4 shows the tool to be used for forming a sheet metal blank located between the pads.

The tool parts that are to be used for the forming of the object to be manufactured in the press can now be placed, with the sheet metal blank 31 to be pressed, between the pressure-transmitting parts 18 and 19 in the manner illustrated in FIG. 4. The sheet metal blank could, for example, consist of a sheet of stainless steel. The tool consists of two parts 32 and 33, each of which makes contact with a respective one of the pre-shaped discs 30 by the side facing the respective pressure-transmitting parts. On the sides facing the cavity, each tool part is provided with an appropriate patterned surface **32*a* and 33*a* each shaped to produce the required embossment of the blank 31. The blank 31 is embossed by press tables 15 and 16 acting via the parts 18 and 19 and the same pressing force P is used as was used for pre-shaping the deformation-resistant discs of cured material 30**.

It will be seen therefore that since the discs of material 30 were formed on either side of an accurately parallel sided plate 21 under a given stress in the mantle 13, the pressing forces acting on the accurately parallel opposed parts 32, 33 of the tool will be compensated for any non-parallelism between the press plates 18, 19, since the press forces act through the pre-shaped discs.

The invention is not to be seen as being limited to the disclosure with reference to the drawing, since many modifications can be made thereto without departing from the spirit and scope of the following claims.

What is claimed is :

1. A method of forming an object by pressing a blank in a tool arranged between two pressure-transmitting parts of a press, said parts being movable in an axial direction relatively toward and away from one another, the method comprising the steps of initially locating a tool-substitute plate, which is resistant to deformation, between said pressure-transmitting parts, said plate having opposed sides respectively facing said pressure-transmitting parts and having at least one of said sides spaced from an adjacent one of said pressure-transmitting parts so as to define at least one gap therewith, locating sealing strip means at least partially into said plate at said one side thereof and bearing against said one pressure-transmitting part so as to delimit said gap in a lateral direction, introducing a formable material into said gap as delimited by said sealing strip means, pressing said parts together with said plate, said sealing means and said material therebetween and transforming said formable material into a solid force-transmitting pad, thereafter removing said tool-substitute plate and said sealing strip means from between said parts, replacing said removal plate and sealing strip means with the tool for pressing the blank and forming the object by pressing the blank with said force-transmitting pad located between the tool and the adjacent pressure-transmitting part.

2. The method according to claim 1, wherein said opposed sides of said plate are respectively spaced from adjacent ones of said parts so as to define gaps therewith, comprising the further steps of locating said sealing strip means at least partially into said plates at said sides thereof and bearing against said pressure-transmitting parts said as to delimit said gaps in a lateral direction, said introducing step including the introducing of the formable material into both said gaps, said pressing step including the pressing of said parts together and transforming said material into solid force-transmitting pads, and forming the object after said removing and replacing steps by pressing the blank with said pads located between the tool and said parts.

3. The method according to claim 1, wherein the pressing forces carried out during both said pressing steps are substantially the same.

4. The method according to claim 3, wherein during the steps of pressing said parts together said material substantially fills said gap.

5. The method according to claim 4, wherein said formable material consists of a thermosetting resin.

6. The method according to claim 3, wherein said pad is resistant to lateral yield during the step of forming the object.

7. The method according to claim 1, wherein said tool-substitute plate is of steel.

8. The method according to claim 1, wherein said sealing strip means comprises a material which is dimensionally stable so as not to be compressed during the first of said pressing steps.

9. The method according to claim 7, wherein said sealing means is located in a groove at said one side of said plate, said sealing means comprising an elastomeric gasket and a rigid sealing strip, during the first of said pressing steps said strip being pressed into said gasket for deforming said gasket partially into said gap.

* * * * *